US010695813B2

(12) United States Patent
Marx

(10) Patent No.: US 10,695,813 B2
(45) Date of Patent: Jun. 30, 2020

(54) SIMULTANEOUS PUSH-PULL WORKSTATION FOR FRAME STRAIGHTENING

(71) Applicant: Michael J. Marx, White Lake, MI (US)

(72) Inventor: Michael J. Marx, White Lake, MI (US)

( * ) Notice: Subject to any disclaimer, the term of this patent is extended or adjusted under 35 U.S.C. 154(b) by 29 days.

(21) Appl. No.: 16/199,311

(22) Filed: Nov. 26, 2018

(65) Prior Publication Data

US 2019/0091746 A1 Mar. 28, 2019

Related U.S. Application Data

(63) Continuation of application No. 15/007,360, filed on Jan. 27, 2016, now Pat. No. 10,155,258.

(60) Provisional application No. 62/108,668, filed on Jan. 28, 2015.

(51) Int. Cl.

| | |
|---|---|
| ***B21D 1/14*** | (2006.01) |
| ***F15B 11/08*** | (2006.01) |
| ***F15B 11/20*** | (2006.01) |

(52) U.S. Cl.

CPC ..... *B21D 1/14* (2013.01); *F15B 11/20* (2013.01); *F15B 2211/20538* (2013.01); *F15B 2211/30575* (2013.01); *F15B 2211/324* (2013.01); *F15B 2211/7052* (2013.01); *F15B 2211/7053* (2013.01); *F15B 2211/7142* (2013.01)

(58) Field of Classification Search

CPC . B21D 1/14; F15B 11/20; F04B 13/00; F04B 53/02; F04B 53/143; F04B 53/144

USPC ..... 320/104; 60/470; 72/705, 457, 453.13; 134/17

See application file for complete search history.

(56) References Cited

U.S. PATENT DOCUMENTS

| | | | | |
|---|---|---|---|---|
| 2,165,504 A * | 7/1939 | Pfauser | B21D 1/14 | 72/392 |
| 2,939,507 A * | 6/1960 | Miller | B21D 1/14 | 72/380 |
| 5,116,425 A * | 5/1992 | Ruef | B08B 3/026 | 134/144 |
| 5,419,497 A * | 5/1995 | Warrington | A62C 25/00 | 137/355.12 |

(Continued)

FOREIGN PATENT DOCUMENTS

| | | |
|---|---|---|
| CN | 200132655 | 5/1993 |
| KR | 10-1260203 B1 | 5/2013 |
| WO | WO-2014120950 A2 | 8/2014 |

OTHER PUBLICATIONS

International Search Report and Written Opinion for Application No. PCT/US2016/015302, ISA/KR, dated May 24, 2016.

(Continued)

*Primary Examiner* — Nathaniel E Wiehe
*Assistant Examiner* — Richard C Drake
(74) *Attorney, Agent, or Firm* — Harness, Dickey & Pierce, P.L.C.

(57) ABSTRACT

A portable workstation includes a frame, a plurality of wheels coupled to the frame, a handle coupled to the frame, a pneumatic inlet port coupled to the frame and a pump coupled to the frame and pneumatically coupled to the pneumatic inlet port. The pump pumps hydraulic fluid. A plurality of hydraulic outlet ports is coupled to the frame and is hydraulically coupled to the pump.

20 Claims, 10 Drawing Sheets

(56) References Cited

U.S. PATENT DOCUMENTS 6,712,677 B2 * 3/2004 Williams ..... B24C 9/00 451/451
6,834,526 B2 * 12/2004 Marx ..... F15B 11/006 72/453.18
7,146,902 B2 * 12/2006 Marx ..... F15B 11/006 91/457
7,269,990 B1 * 9/2007 Espinosa ..... B21D 1/14 72/305
7,975,856 B2 * 7/2011 Gilpatrick ..... B08B 3/026 211/70.6
8,602,323 B2 * 12/2013 Bearup ..... B62B 1/12 239/146
9,327,328 B1 * 5/2016 Ceballos, Sr. ..... B21D 1/14
2003/0066333 A1 * 4/2003 Thomas ..... B21D 1/14 72/705
2007/0188013 A1 * 8/2007 Hoffman ..... B60T 17/02 303/10
2007/0267512 A1 * 11/2007 Raabe ..... E01C 19/17 239/9
2019/0100888 A1 * 4/2019 Hand ..... B05B 9/007

OTHER PUBLICATIONS

Parker Hannafin Corporation, "Packaged Pressure Systems", Nov. 2012. retrieved from https://www.autoclave.com.
Parker Hannafin Corporation, "Air Driven, High Pressure Liquid Pumps" May 2015,. retrieved from https://www.autoclave.com.
Trinkel, Bud. "Chapter 7: Air and Hydraulic Filters, Air Dryers and Lubricators" Hydraulics & pneumatics. Nov. 30, 2006. retrieved from https://www.hydraulicspneumatics.com/other-technologies/chapter-7-air-and-hydraulic-filters-air-dryers-and-lubricators.

* cited by examiner

SIMULTANEOUS PUSH-PULL WORKSTATION FOR FRAME STRAIGHTENING

CROSS-REFERENCE TO RELATED APPLICATIONS

This application is a continuation of U.S. patent application Ser. No. 15/007,360 filed on Jan. 27, 2016. This application claims the benefit of U.S. Provisional Application No. 62/108,668, filed on Jan. 28, 2015.

FIELD

The present disclosure relates generally to hydraulic systems, and more specifically, to an apparatus to couple a hydraulic actuator or other equipment to a frame deck.

BACKGROUND

This section provides background information related to the present disclosure which is not necessarily prior art.

Frame racks are typically used to straighten the frame of an automotive vehicle after a collision. A frame rack has a deck onto which the vehicle is placed. A number of towers are positioned around the frame rack. The towers have a chain connected thereto that is coupled to a ram or actuator. The chains are connected to the frame of the vehicle and the tower is used to pull the chain toward the tower. Typically, the chains are connected to the vehicle so that the vehicle frame is pulled out in the same direction of impact. When the pulling of the frame begins, it is often necessary to adjust the direction of pulling so the pulling force remains in the direction of impact. Oftentimes, this requires the tension to be released from the vehicle, the tower position to be adjusted, and tension placed on the vehicle frame in a slightly different direction. This, however, is a time consuming process and thus increases the expense of the collision repair.

To place tension on the vehicle in a slightly different direction, a separate hydraulic ram is sometimes coupled to a frame deck. The hydraulic ram may provide push and pull capabilities. Because a tower may not be available, a portable hydraulic ram may be used. The portable hydraulic ram is typically coupled to the frame deck using hooks. One problem with using a hook is that the frame deck is typically formed of a sheet of steel material, commonly 0.5" thick. Although the thickness is substantial, the frame deck may easily be bent when localized pulling on the order of thousands or even tens of thousands of pounds takes place during a straightening operation. If the frame rack is damaged, expensive repairs may be required to be performed. This may result in lost time and thus revenue for the frame rack operator.

Frameracks may not have the means to provide force in all the directions required for a complex straightening operation. Multiple single acting rams in addition to those provided with the frame rack may be required. Controlling such systems is inconvenient and time consuming.

SUMMARY

This section provides a general summary of the disclosure, and is not a comprehensive disclosure of its full scope or all of its features. The present disclosure provides a system for allowing flexibility in the frame straightening process and to allow simultaneously pulling at various angles with respect to the deck.

In one aspect of the disclosure, a portable workstation includes a frame, a plurality of wheels coupled to the frame, a handle coupled to the frame, a pneumatic inlet port coupled to the frame and a pump coupled to the frame and pneumatically coupled to the pneumatic inlet port. The pump pumps hydraulic fluid. A plurality of hydraulic outlet ports is coupled to the frame and is hydraulically coupled to the pump.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected examples and not all possible implementations, and are not intended to limit the scope of the present disclosure.

Corresponding reference numerals indicate corresponding parts throughout the several views of the drawings.

DETAILED DESCRIPTION

Figure 1:
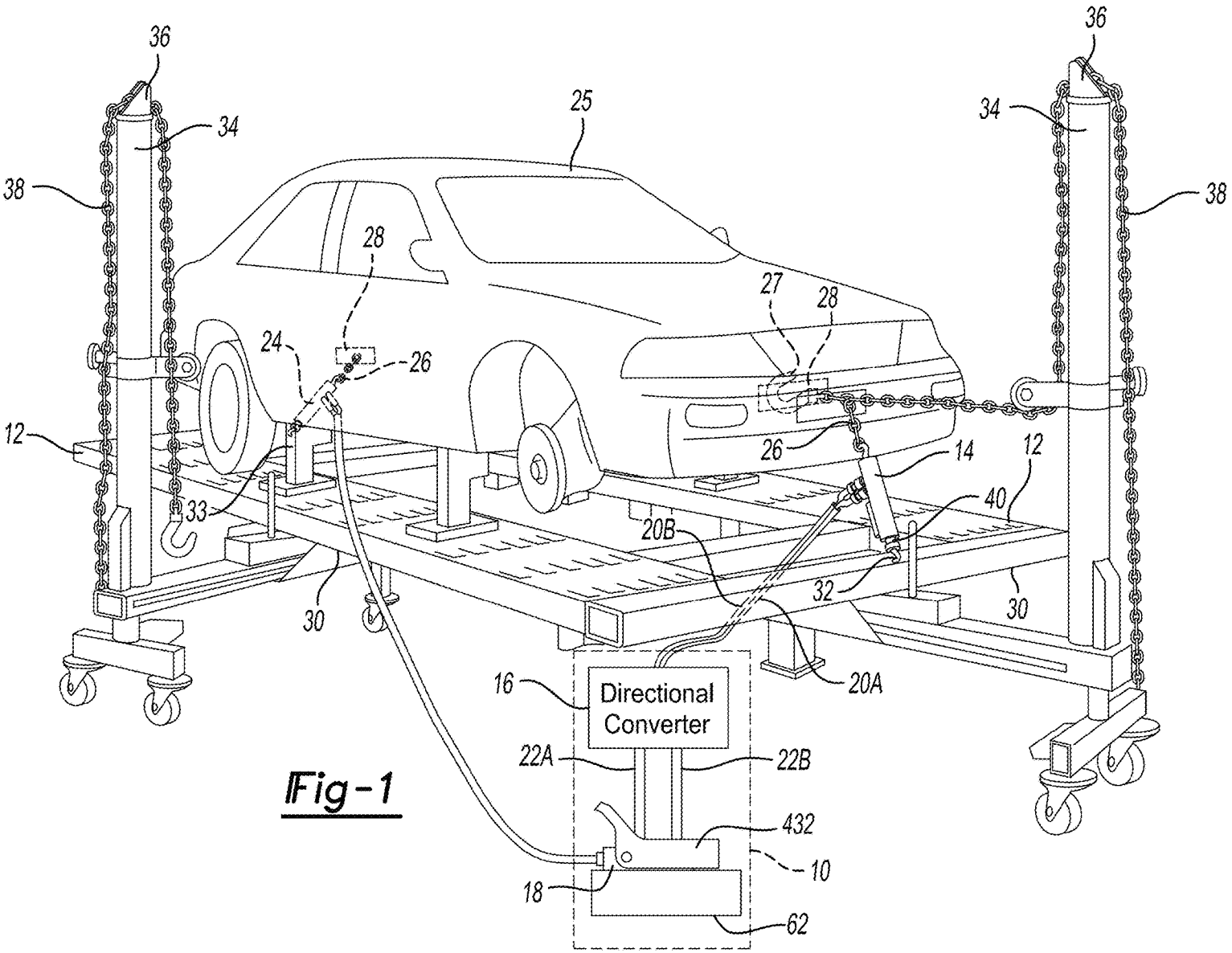
FIG. 1 is an isometric view of a vehicle mounted on a frame deck and hydraulic systems coupled to the vehicle and anchored to the frame deck using a deck leverage anchor according to the present disclosure.

Examples will now be described more fully with reference to the accompanying drawings.

In the following figures, the same reference numerals will be used to identify the same components. The following description is set forth with respect to a frame rack for an automotive vehicle. However, the present application has several uses that use simultaneous hydraulic operations The drawings are to scale, and the geometric relationships (e.g., angles, proportions) between elements shown in the drawings are in accordance with the principles in the present disclosure. However, the drawings are provided for illustrative purposes only and should not be limiting unless set forth in the claims of the present disclosure. Further, the examples set forth herein illustrate various alternative features. The various features, however, may be interchanged in the different examples.

Referring now to FIG. 1, a hydraulic system 10 according to the present disclosure is illustrated. Hydraulic systems 10 are illustrated used on a frame rack 12. As mentioned above, however, the frame rack 12 is merely illustrative of one of the many applications of the present disclosure. Hydraulic system 10 includes a dual-acting hydraulic actuator 14, a directional converter 16, and a pump 18. A suitable hydraulic directional converter 16 is described in U.S. Pat. No. 6,834,526, filed on Jun. 5, 2002, the disclosure of which is incorporated by reference herein.

As illustrated, two hoses 20A and 20B, fluidly couple directional converter 16 and hydraulic actuator 14. Also, two hoses 22A and 22B fluidly couple directional converter 16 and pump 18. The dual-acting hydraulic actuator 14 and may have a mechanical coupling device such as a pair of claw hooks or other mechanical fastening devices such as bolt down components, loops, stays, or a deck leverage anchor 40 according to the present disclosure.

A single acting hydraulic actuator 24 may also be coupled to the pump 18. The hydraulic actuators 24 are each coupled with a single hose 20C to the hydraulic pump 18.

The pump 18 may be a hydraulic pump that is run using a pneumatic source. A pneumatic source is available in most auto body repair shops. The air source pressurizes the hydraulic pump 18 to increase the fluid of hydraulic fluid or oil therein.

Chains 26 may be used to couple the various components such as the dual-acting hydraulic actuator 14 and the single-acting hydraulic actuator 24 to a vehicle 25. The chains may include hooks 27 or other devices for coupling to the vehicle 25. A further description of this hydraulic system 10 will be set forth below. A mounting plate 28 may receive the hook 27.

Frame rack 12 may also include various towers 34 that include a guide 36 and a chain 38. Of course, different numbers of towers 34 may be used on a frame rack. A support 33 may be used to support the vehicle. Frame rack 12 has a deck 30 for positioning a vehicle thereon. Deck 30 may have openings 32 or tie down holes positioned therethrough. Deck leverage anchor 40 may be secured at least partially within one of the openings 32.

The hydraulic system may be used to act together with the hydraulics in the tower 34 to perform pulling in the desired directions.

Figure 2:
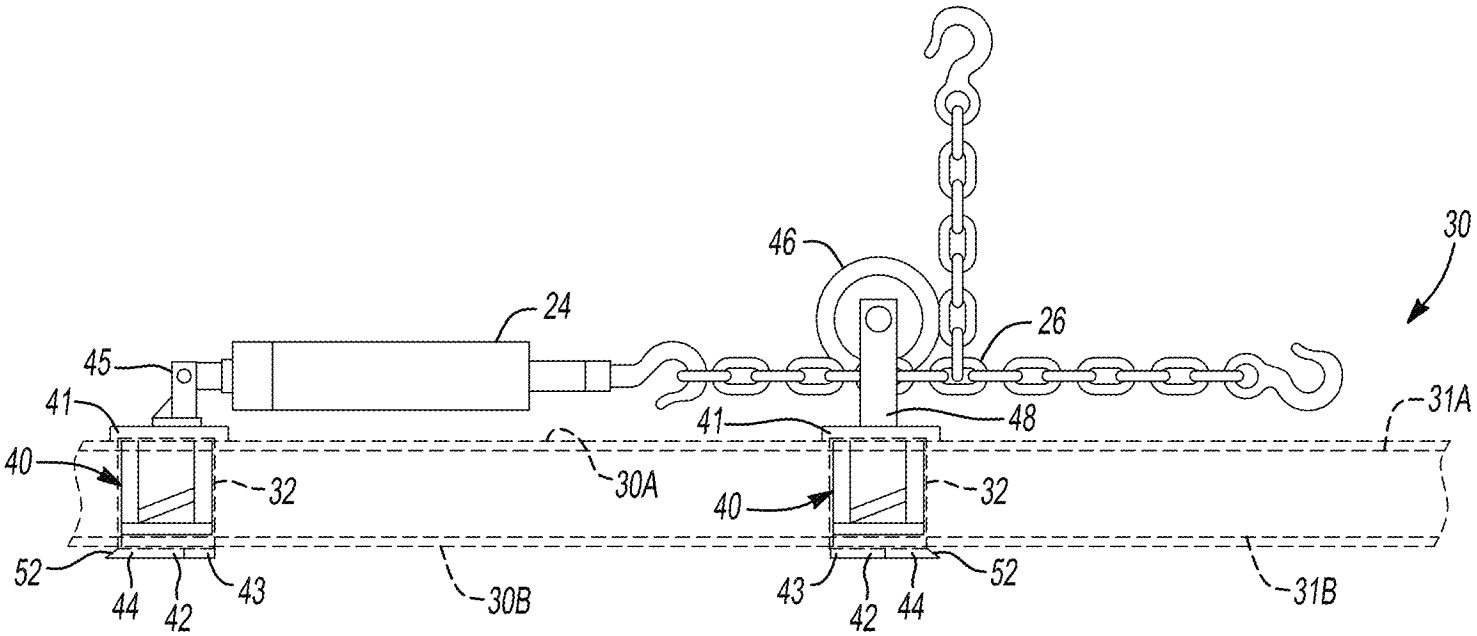
FIG. 2 is a side view of a hydraulic system anchored to a frame deck using a deck leverage anchor according to the present disclosure.

Referring now to FIG. 2, hydraulic actuator 24 is illustrated coupled to deck 30. Deck 30 is shown in phantom to illustrate components that may otherwise be hidden. Deck 30 may have a first surface 30A spaced apart from and/or parallel to a second surface 30B. The first surface 30A may be disposed on an upper plate 31A of deck 30, and the second surface 3AB may be disposed on a lower plate 31B of deck 30. The upper plate 31A and the lower plate 31B may be spaced apart from and/or parallel to each other.

Deck leverage anchor 40 includes an upper plate 41, a lower plate 42, and a swivel plate 43 that swivels with respect to the lower plate 42. The upper plate 41 and the lower plate 42 may be vertically spaced apart and connected to each other using spacers or risers, as discussed below.

Deck leverage anchor 40 may be inserted into the opening 32 such that the upper plate 41 engages or rests on the first surface 30A and a flange 44 on the lower plate 42 engages the second surface 30B. The upper plate 41 and the lower plate 42 of deck leverage anchor 40 may be parallel to the upper plate 31A and the lower plate 32A of deck 30. The profile of the lower plate 42 may be sized to fit within the opening 32 to allow insertion of deck leverage anchor 40 into the opening. An optional swivel plate 43 may then be rotated from an unlocked position to a lock position such that the swivel plate 43 engages the second surface 30B. The swivel plate 43 and components used to rotate and/or retain the swivel plate 43 may be collectively referred to as a locking mechanism. In certain configurations, the locking mechanism may be removed and a solid structure may be formed in the same shape as the unrotated swivel plate.

Hydraulic actuator 24 is coupled to deck 30 using an actuator coupler 45. Actuator coupler 45 couples hydraulic actuator 24 to deck leverage anchor 40. As discussed in more detail below, actuator coupler 45 may be rotated with respect to deck leverage anchor 40 and independent from the swivel plate 43.

A pulley 46 may also be coupled to deck 30. Pulley 46 may be coupled to deck 30 using a pulley coupler 48. Pulley coupler 48 couples pulley 46 to deck leverage anchor 40. As discussed in more detail below, pulley coupler 48 may be rotated with respect to deck leverage anchor 40 and independent from the swivel plate 43. The hydraulic actuator 24 and the pulley 46 may be referred to as frame loading members, as the hydraulic actuator 24 and the pulley 46 are used to apply a load on a vehicle frame.

Figure 3:
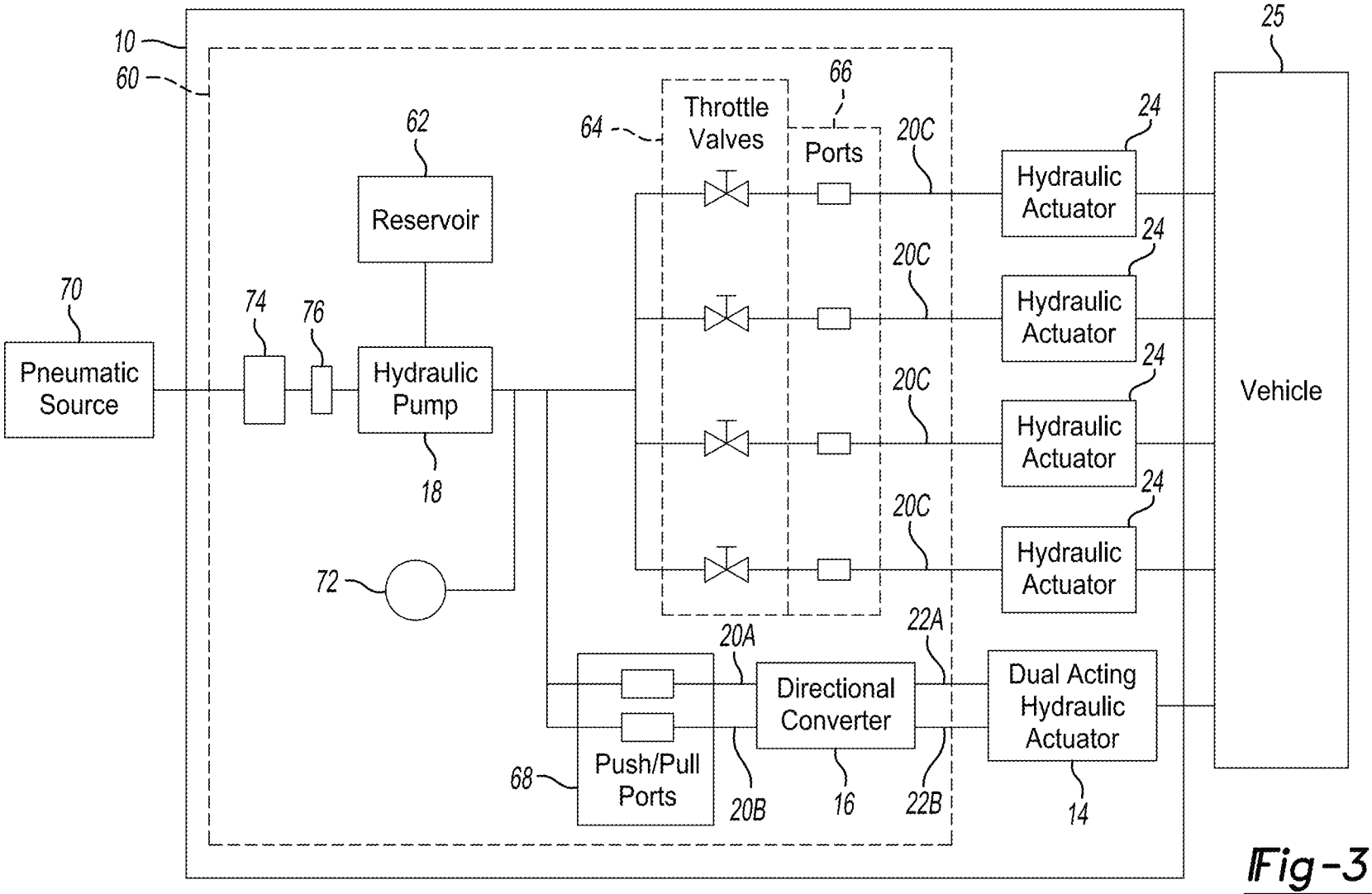
FIG. 3 is a schematic view of the pneumatic and hydraulic circuits according to the present disclosure.

Referring now to FIG. 3, the hydraulic system 10 is illustrated in further detail. The hydraulic system 10 may include a portable workstation 60 that is used for conveniently maneuvering the various hydraulic components thereon. The configuration of the workstation 60 will be described in further detail below. The hydraulic components of the workstation 60 include the hydraulic pump 18, the directional converter 16, and the hoses 20A and 20B. A hydraulic fluid reservoir 62 may be coupled to the hydraulic pump 18 for communicating hydraulic fluid or oil to the hydraulic pump 18. The workstation 60 may also include throttle valves 64 that are in fluid communication with the hydraulic actuators 24. The throttle valves 64 may be used to individually control the outputs at each of the ports 66. The ports 66 may be physical couplings that are used to connect hoses 20C between the hydraulic pump 18 and the hydraulic actuator 24. In one constructed example, the ports 66 may be quick-disconnect ports, to allow quick and reliable connections for the hoses 20C. In this example, four ports 66 are illustrated. However, fewer or greater numbers of ports may be provided within the workstation 60.

Push-pull ports 68 may also be included within the workstation 60. Push-pull ports 68 are used to hydraulically couple the hydraulic pump 18 and the directional converter 16 with the dual-acting hydraulic actuator 14. The push-pull ports 68 may be coupled to the hoses 20A, 20B. The push-pull ports 68 communicate fluid to or from the directional converter 16 as will be further described in detail below relative to the directional converter described in FIGS. 4-10.

A pneumatic source 70 outside of the hydraulic system 10 and the workstation 60 may be coupled to the hydraulic pump 18. The pneumatic source 20 may be a source such as a shop source, or another type of air compressor. Of course, the pneumatic source 70 could be part of the workstation 60.

The hydraulic actuators 24 may be stored on the workstation 60, but in use, are illustrated within the hydraulic system 10 but outside the workstation 60. The hydraulic actuators 24 are mechanically coupled to the vehicle 25 through the chains or other mechanical devices illustrated in FIG. 1. Likewise, the dual-acting hydraulic actuator 14 is mechanically coupled to the vehicle 25 through mechanical means. The dual-acting hydraulic actuator 14 may be stored on the workstation 60, but may not be fixed to the workstation 60 while in use. That is, the hoses 22A and 22B may couple the dual-acting hydraulic actuator 14 to the directional converter 16.

Figure 4:
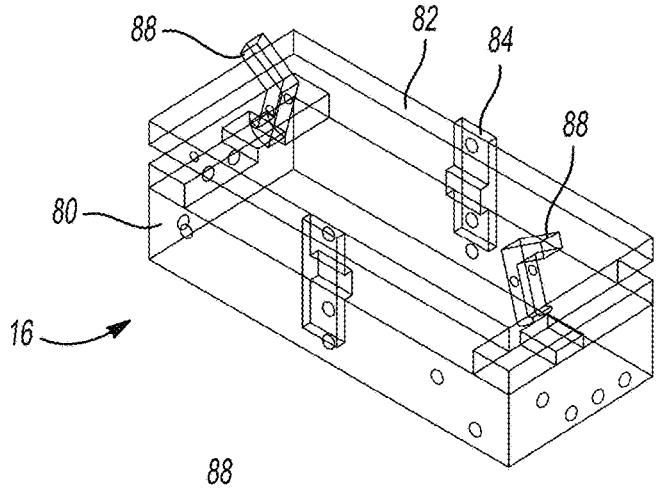
FIG. 4 is a perspective view of the directional converter.
Figure 5:
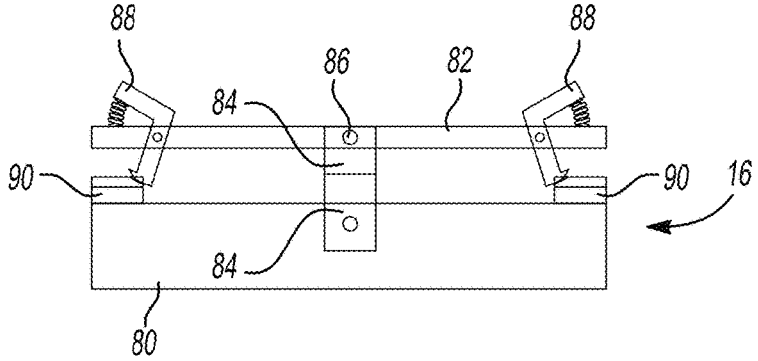
FIG. 5 is a side view of the directional converter of FIG. 4.

Referring now to FIGS. 4 and 5, a first example of a directional converter 16 is illustrated in further detail. Directional converter 16 has a housing 80 and a foot pedal 82 that is pivotably attached thereto. A pair of pedal hinges 84 attached through a pedal pin 86 is used to pivot the foot pedal 82 about the pedal pin 86. A lock 88 may be located on each side of pedal 82. Lock 88 is used to engage a catch 90 positioned on housing 80. Catches 90 engage lock 88 to maintain the pedal 82 in a pivoted position. As illustrated, lock 88 extends through pedal 82. However, various types of locks may be evident to those skilled in the art.

Figure 6:
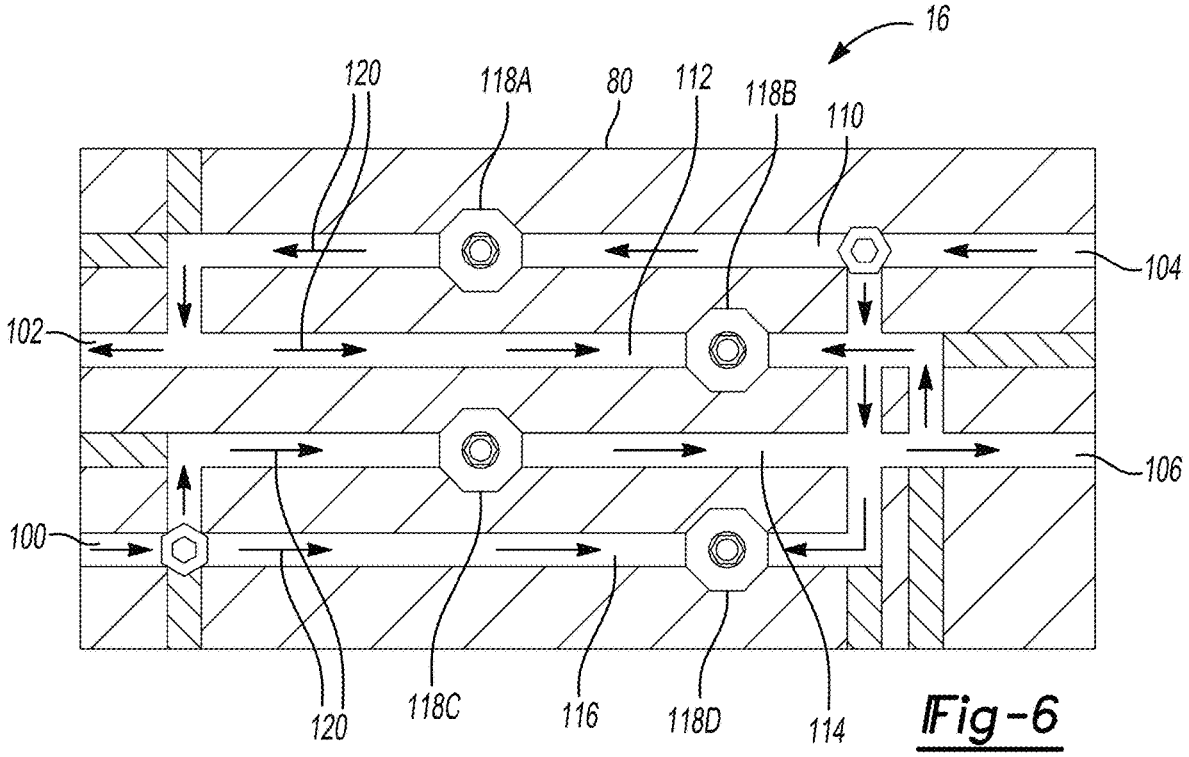
FIG. 6 is a cross-sectional view of the directional converter of FIGS. 4 and 5, showing the fluid passages in a cylinder up direction.

Referring now to FIG. 6, a cutaway view of housing 80 is illustrated in further detail. Housing 80 has a plurality of ports that are coupled to the pump and to the actuator. Preferably, four ports are provided. The ports include a pump outlet port 100, a pump inlet port 102, a first actuator port 104, and a second actuator port 106.

A plurality of fluid passages is provided between pump outlet port 100, pump inlet port 102, first actuator port 104, and second actuator port 106. As illustrated, four fluid passages are illustrated. A first fluid passage 110 is coupled between pump inlet port 102 and first actuator port 104. A second fluid passage 112 is coupled between pump inlet port 102 and second actuator port 106. A third fluid passage 114 is fluidically coupled between the pump outlet port 100 and the first actuator port 104. A fourth fluid passage 116 is fluidically coupled between the pump outlet port 100 and the first actuator port 104.

Each of the fluid passages 110, 112, 114, and 116 has a respective valve 118A-118D therein. Preferably, valves are normally closed valves. Valves 118 may be manually operated such as by foot pedal 82 above. Upon the application of pressure to the top portion of valve 118, the valve may open to allow fluid through the respective passage. In this figure, valves 118A and 118C are open and valves 1188 and 118D are closed. This is referred to as a plurality of valves having a first position. The fluid flow is illustrated by arrows 120. This configuration corresponds to moving actuator up or outward. In the first fluid passage, fluid is returned from the actuator through first actuator port 104, which is coupled to the pump inlet port 102, which in turn is fluidically coupled to the reservoir of the pump. Fluid is provided to the actuator from the pump through pump outlet port 100 and is transferred through third fluid passage 114 to second actuator port 106. Because valves 118B and 118D are closed, no fluid flows through second fluid passage 112 and fourth fluid passage 116.

Figure 7:
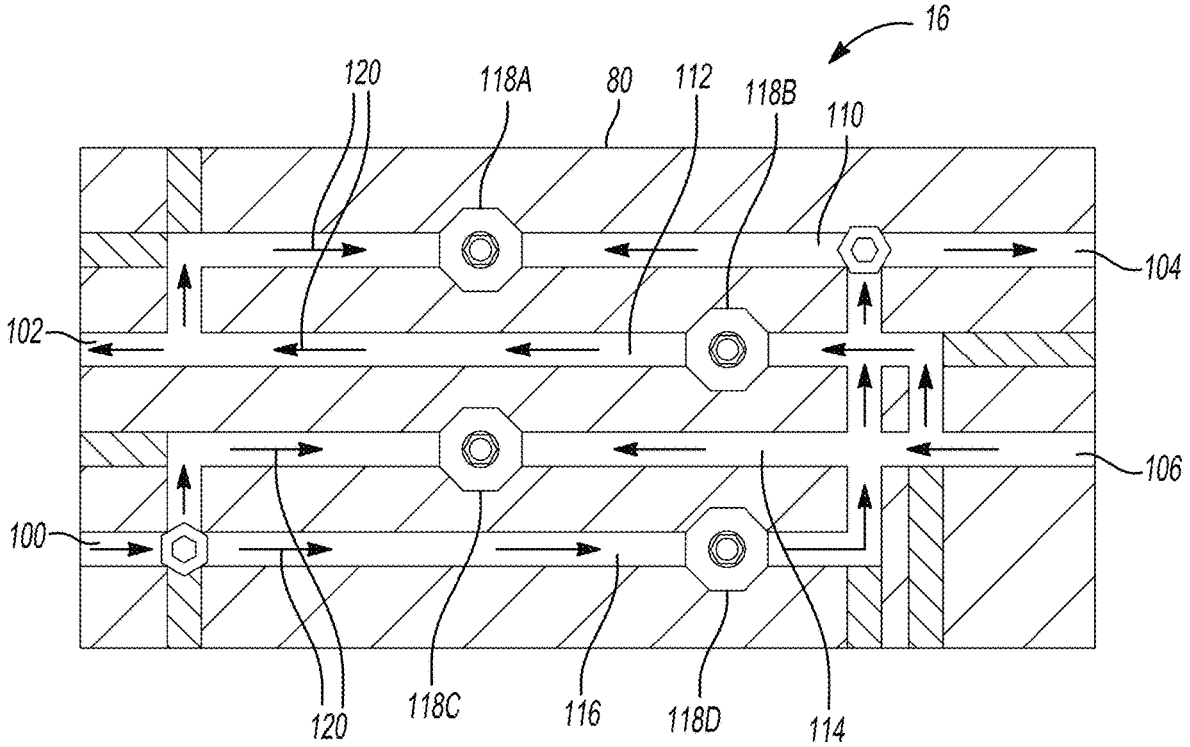
FIG. 7 is a cross-sectional view of the directional converter of FIGS. 4 and 5 showing the fluid passages in a cylinder down direction.

Referring now to FIG. 7, the position of valves 118A-118D may be referred to as the plurality of valves being in a second position. That is, valves 118A and 118C are now closed while valves 118B and 118D are open. In this manner, fluid flows from second actuator port 106 through valve 118B to pump inlet port 102. Fluid flows from pump outlet port 100 through valve 118D to first actuator port 104. This configuration corresponds to retracting the actuator.

Figure 8:
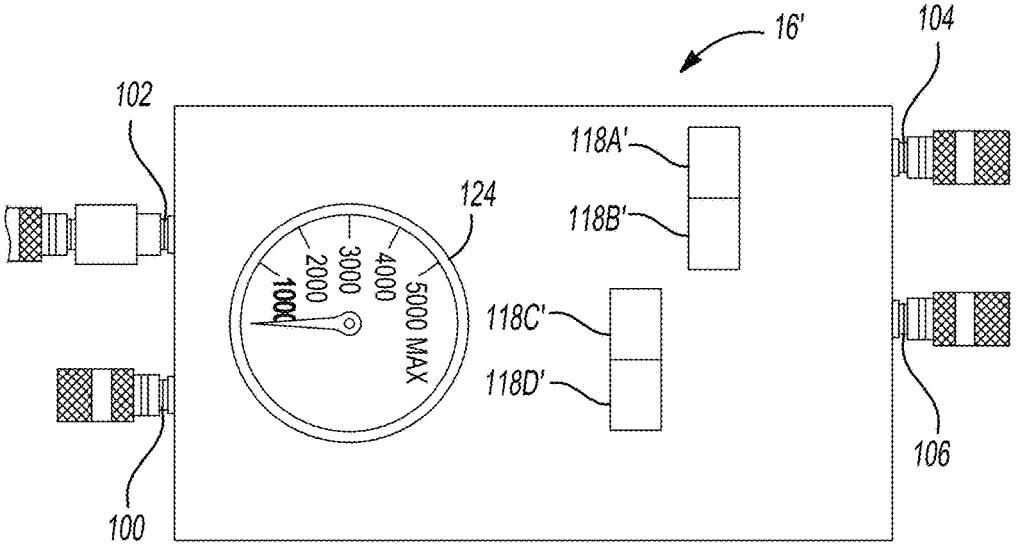
FIG. 8 is an alternative configuration of a directional converter according to a second example of the disclosure.
Figure 9:
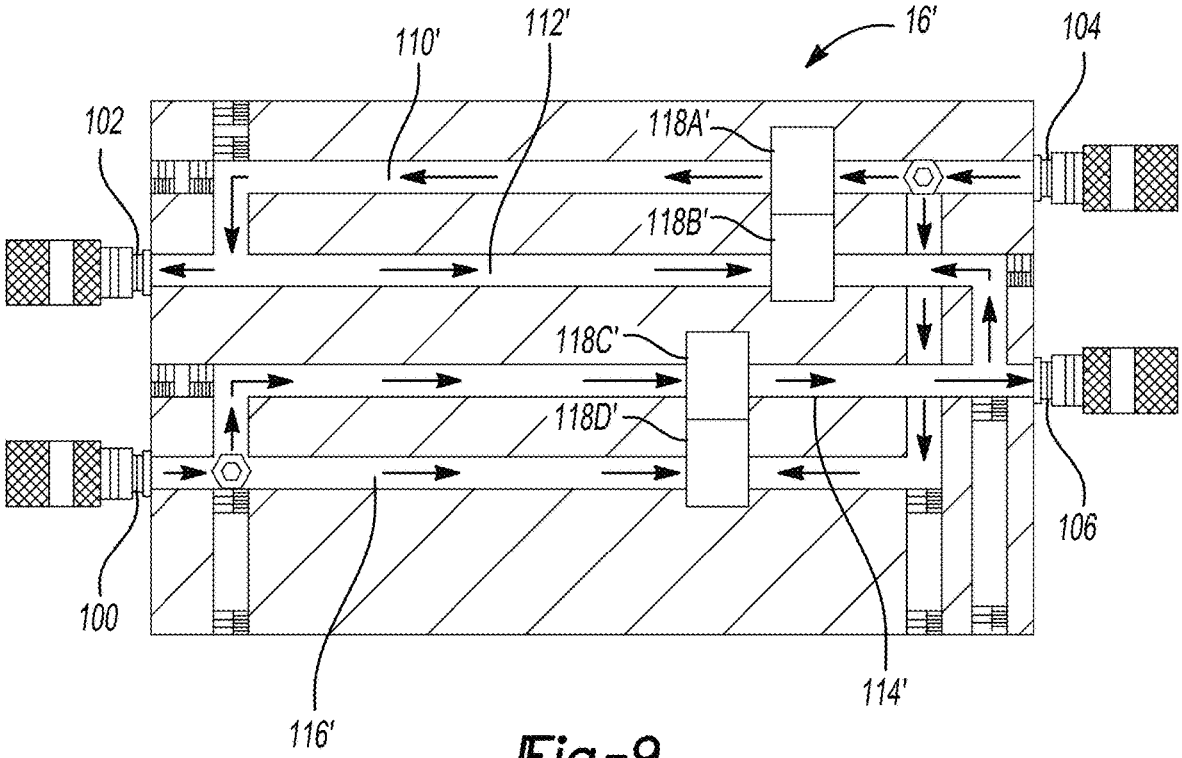
FIG. 9 is a cross-sectional view illustrating the fluid passage of the example illustrated in FIG. 8.

Referring now to FIG. 8, a second example of a hydraulic directional converter 16' is illustrated. Directional converter 16' in this example has a pressure gauge 124 that is fluidically coupled to pump outlet port 100 to measure the hydraulic fluid from the pump. In this example valves 118A', 118B', 118C', and 118D' have been located in slightly different positions than those of valves 118A-118D shown in FIGS. 6 and 7 but still in the same passages. Valves 118A'-118D' in this example may be hand operated rather than operated by a foot pedal 82 shown above. The operation of FIG. 9 is similar to that of FIG. 6 in that the fluid flows through the directional converter 16' in a similar manner.

Figure 10:
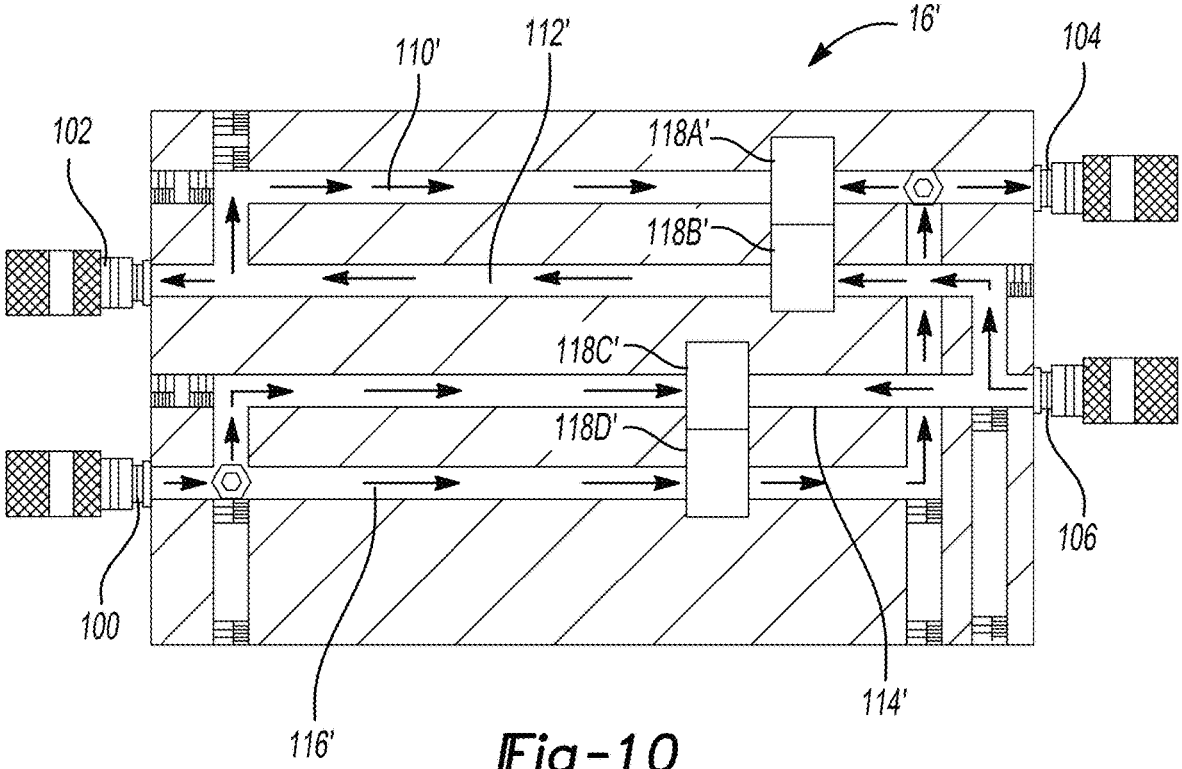
FIG. 10 is a cross-sectional view of the fluid passages of the example set forth in FIG. 8.
Figure 11:
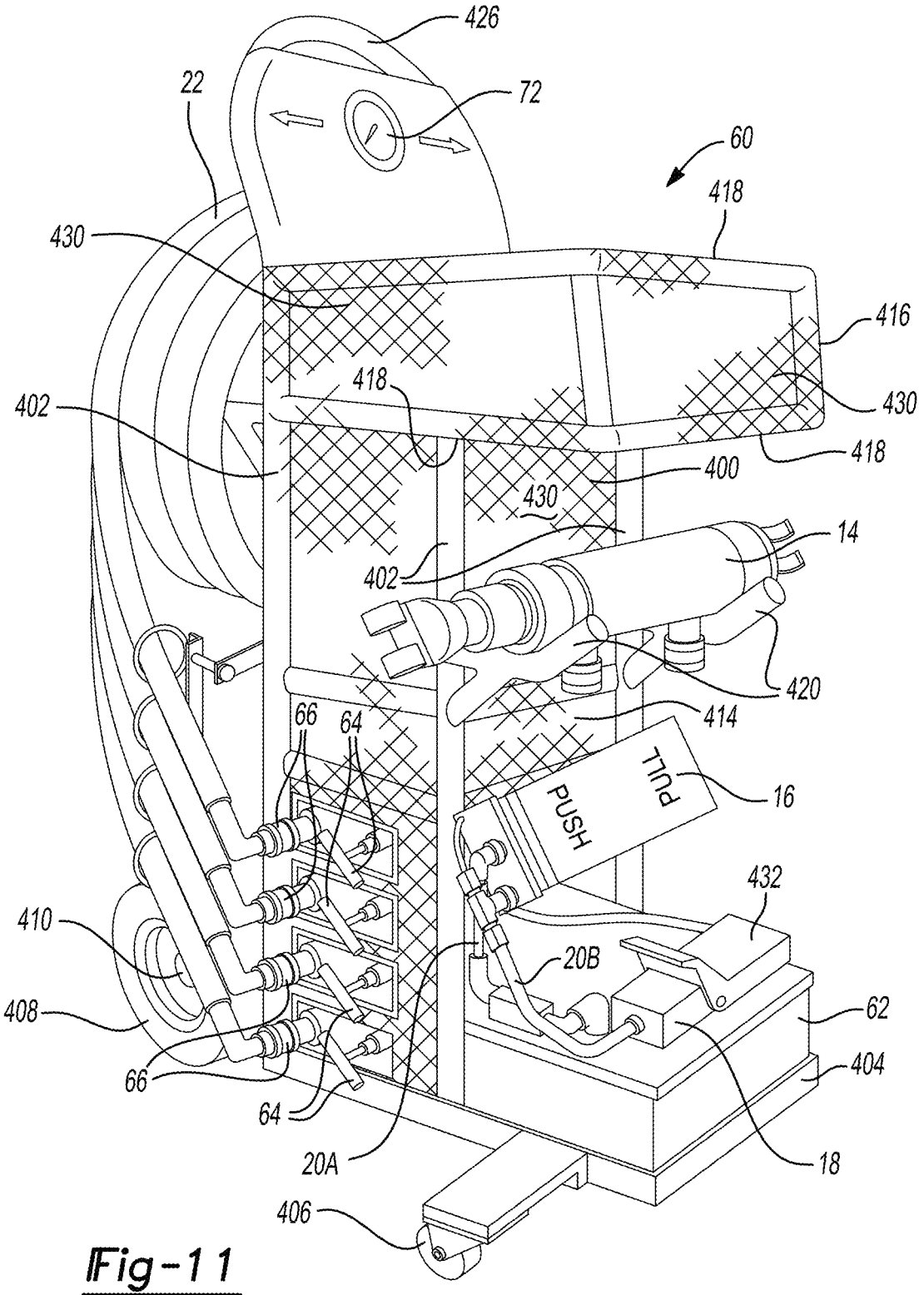
FIG. 11 is a perspective view of the cart according to the present disclosure.
Figure 12:
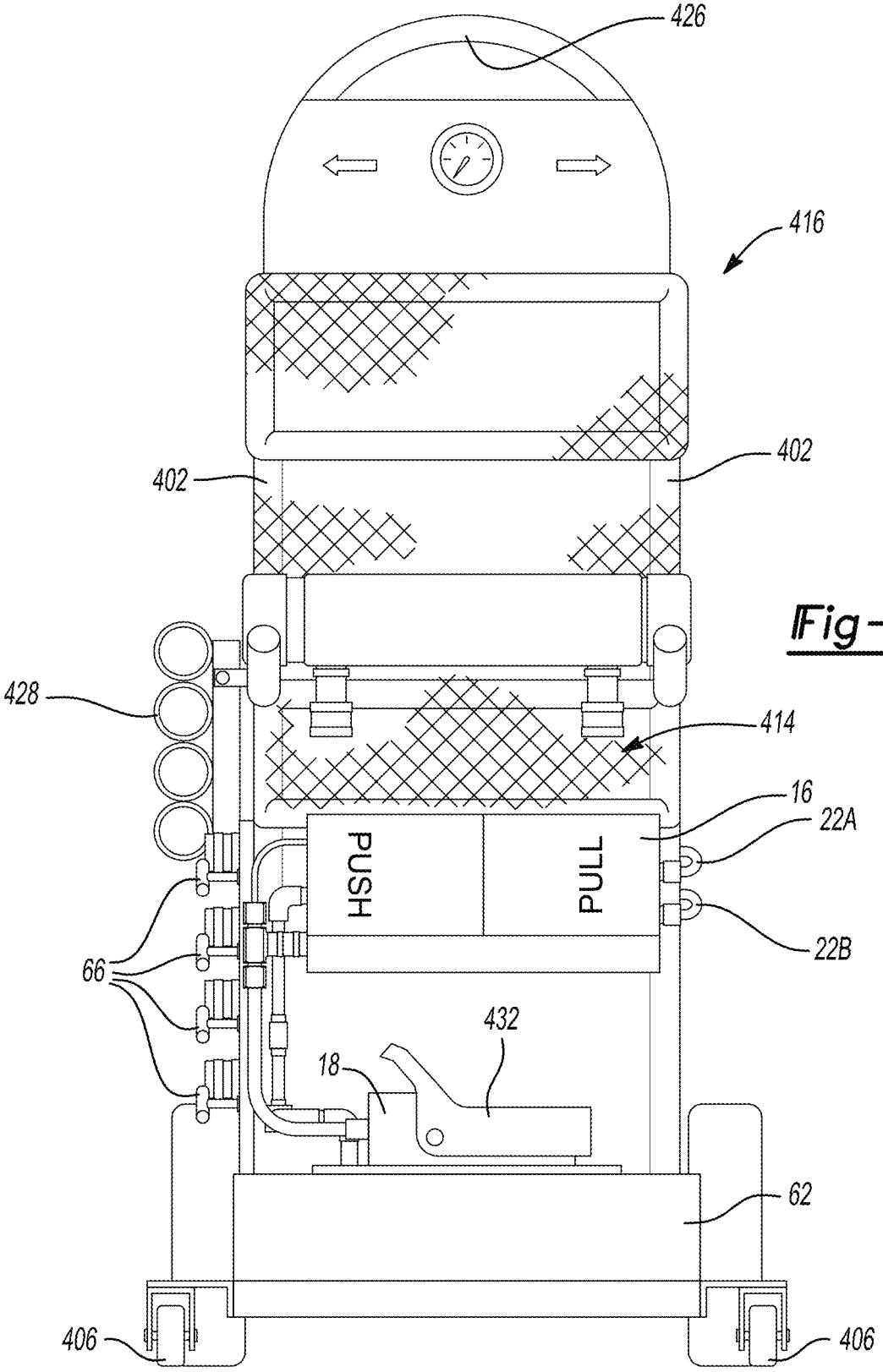
FIG. 12 is a front view of the cart according to the present disclosure.

Referring now to FIG. 10, a typical valve 118 is illustrated in further detail. To facilitate assembly, valve 118 has threads 130 thereon which may be used to secure valves 118 within an opening 132. As is illustrated, the fluid passages may be in more than one plane. Fluid passes through the valve 118 when it is opened through valve ports 134 which in turn allow the fluid to flow through a bottom portion 136 of valve 118.

Referring now to FIGS. 11-14, details of the workstation 60 are set forth. The workstation 60 includes a frame 400. The frame 400, as illustrated, includes four vertical members 402 that are coupled to a base 404. The base 404 may be used to support the reservoir 62 and the pump 18. The base 404 may also be used to support front wheels 406 and rear wheels 408. The front wheels 406 may have the capability of swiveling so that the workstation 60 may be easily steered. An axle 410 may extend between the rear wheels 408. However, the rear wheels 408 could be swivel type as well. The frame 400 may be formed of various materials including, but not limited to, metal or composites.

The vertical members 402 are used for supporting various components of the workstation including the directional converter 16, forming a first basket 414, and forming a second basket 416. The baskets 414 and 416 have bottoms that extend horizontally. The first basket 414 may be used for storing various components used in the frame straightening process, such as, but not limited to, chains and leverage anchors. The second basket 416 may be used for storing various accessories. In the constructed example, the second basket 416 is larger than the first basket 414. The second basket 416 is formed of cross members that are coupled to the vertical members 402. The second basket 416 may be used to store the hydraulic actuator 14.

The dual-acting hydraulic actuator 14 may be stored using support arms 420 extending from the forward-most vertical members 402.

A hose support 422 may receive the hoses 422 for storage and maneuvering.

The rear-most vertical members 402 may also have a handle 426 extending therefrom. The handle 426, in the constructed example, is rounded and extends between the two rear-most vertical members 402.

A pressure gauge 72 may also be included within the hydraulic system 10. The pressure gauge 72 may, for example, be used to display the pressure output of the hydraulic pump 18. The pressure gauge 72 may be mounted adjacent to the handle 426. The face of the pressure gauge 72 may face forward in the system.

A hose guide 428 may also be coupled to one of the vertical members 402. As illustrated best in FIG. 11, the hose guides 428 may be used to receive the hoses 22. The hose guides 428 increase the reliability of the system by relieving the mechanical stress at the ports 66 from the hoses being moved. In this example, the hose guides 428 have four hose positions for receiving four hoses that are coupled to the four ports 66. Of course, the number of positions of the hose guide 428 may vary depending on the number of hoses and ports.

The workstation 60 may have metal mesh 430 that is used to form the first basket 414, the second basket 416, and to provide a mounting surface for the ports 66 and the throttle valves 64. The metal mesh 430 may form side panels and a bottom of the baskets and the rear panel of the workstation 60.

The base 404 may be formed of a solid panel material or the mesh 430. The base 404 is used to support the reservoir 62 and the pump 18. A foot pedal 432 extends from the pump 18 to allow the pump 18 to be actuated thereby.

Figure 13:
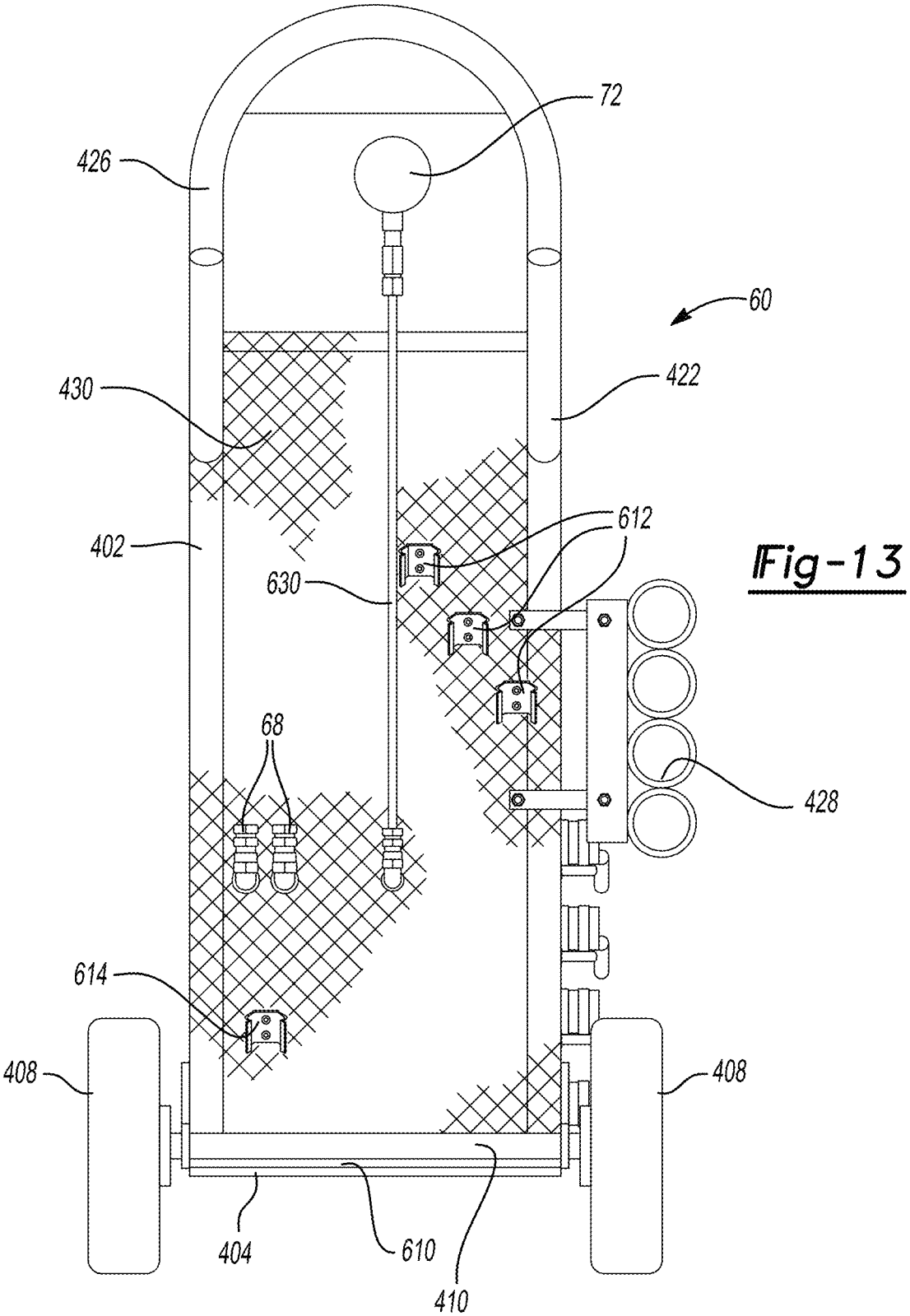
FIG. 13 is a rear view of the cart according to the present disclosure.
Figure 14:
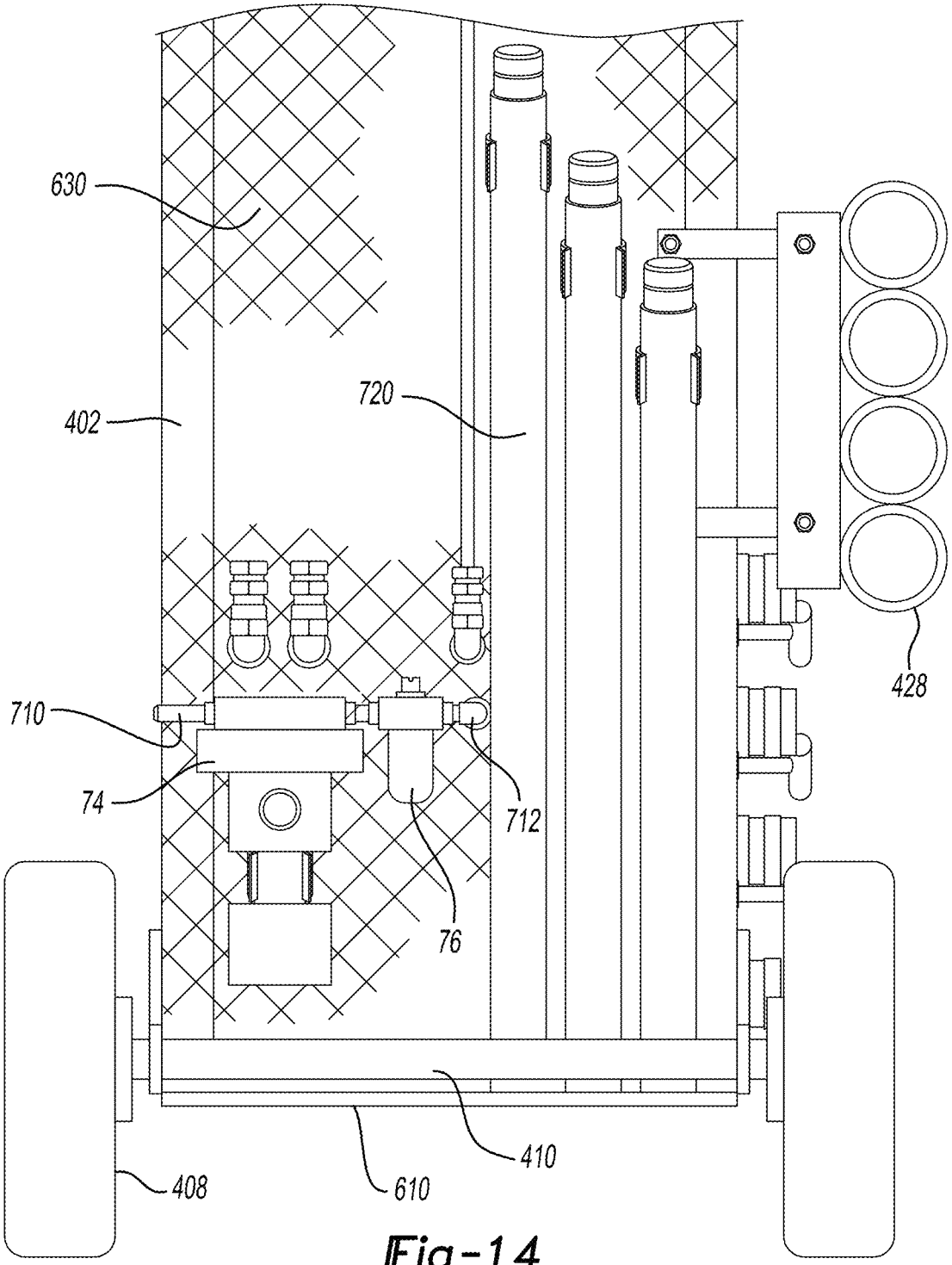
FIG. 14 is a rear view of the cart including an automatic oiler, a water separator, and extensions mounted to the cart.

Referring specifically to FIGS. 13 and 14, the base 404 may extend rearward to form a tray 610. The tray 610 is coupled to the vertical members and extends horizontally. The tray 610, in combination with extension holders 612, may be used to hold extensions 720 for use with the hydraulic actuators 14, 24. Of course, the tray 610 may be used for holding other tools or devices used for the particular type of industry in which the workstation 60 is used. A holder 614 may also extend from the rear of the workstation 60. The holder 614 may be used to hold a component such as a water separator and an automatic oiler, as will be described below. The holder 614 and the extension holder 612 may be mounted to the mesh 630.

The mesh 630 may also be used to support the push-pull ports 68. As mentioned above, each port 68 may be capable of receiving and communicating hydraulic oil therethrough. The ports 68 are in hydraulic communication with the directional converter 16.

Referring now to FIG. 14, a water separator 74 may be included within the pneumatic circuit. The water separator 74 may be used to separate water from the incoming pneumatic source 70 to reduce wear and tear on the system. An automatic oiler 76 may also be used within the system to automatically provide a predetermined amount of oil to lubricate the pump 18. The water separator 74 and the oiler 76 are disposed in series.

The mesh 630 may also be used to support the water separator 74 and the automatic oiler 76. A pneumatic inlet port 710 and a pneumatic outlet port 712 are used to receive air through the series combination of the water separator 74 and the oiler 76. The pneumatic outlet port 712 is in communication with the hydraulic pump 18. The air from the pneumatic outlet port 712 is communicated to the pump 18 for driving the pump 18.

In FIG. 14, the extension holders 612 are illustrated holding extension 720.

Although four ports, four hydraulic actuators, and one dual-acting hydraulic actuator are illustrated in the above example, fewer or greater numbers of hydraulic actuators may be implemented, depending upon the system capabilities required. In different industries, it is envisioned that different types of requirements will be met. Also, the size and proportion of the components of the workstation 60 may be altered. A lower, wider workstation may be used to fit within the back end of a pickup truck without tipping.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A portable workstation comprising:

a tray or basket;

a frame comprising a plurality of vertical members;

a plurality of wheels coupled to the frame;

a handle coupled to the vertical members of the frame;

a hose support coupled to the vertical members;

a pneumatic inlet port and a pneumatic outlet port coupled to the frame;

a dual acting ram support arm coupled to the vertical members of the frame;

a directional converter coupled to the frame and hydraulically coupled to the pump, said directional converter comprising a pair of push pull ports, said push pull ports coupled to a dual acting ram;

said pump coupled to the frame and pneumatically coupled to the pneumatic inlet port, said pump pumping hydraulic fluid; and a plurality of hydraulic outlet ports coupled to the frame and hydraulically coupled to the pump coupled to a single action actuator.

2. The portable workstation as recited in claim 1 wherein the frame or basket comprises a first basket coupled to the frame.

3. The portable workstation as recited in claim 2 wherein the frame or basket comprises a second basket coupled to the frame.

4. The portable workstation as recited in claim 3 wherein the second basket is below the first basket.

5. The portable workstation as recited in claim 4 wherein the frame or basket comprises a tray, a first basket and a second basket.

6. The portable workstation as recited in claim 1 further comprising a hose guide coupled to the frame.

7. The portable workstation as recited in claim 1 further comprising a hydraulic directional converter hydraulically coupled to the pump for coupling to a dual-acting hydraulic actuator.

8. The portable workstation as recited in claim 7 further comprising a dual-acting hydraulic actuator.

9. The portable workstation as recited in claim 1 wherein a pair of push-pull ports comprise a first push-pull port and a second push-pull port and wherein a plurality of single acting ports that simultaneously operate the directional converter in either direction together with the single action actuator.

10. The portable workstation as recited in claim 1 further comprising a pressure gauge coupled to an outlet of the pump.

11. The portable workstation as recited in claim 1 further comprising a water separator coupled to the frame.

12. The portable workstation as recited in claim 1 further comprising an automatic oiler coupled to the frame.

13. The portable workstation as recited in claim 1 further comprising a water separator and an automatic oiler coupled to the frame.

14. The portable workstation as recited in claim 13 wherein said water separator and said automatic oiler pneumatically coupled between the pneumatic inlet port and the pneumatic outlet port.

15. The portable workstation as recited in claim 1 further comprising a hose guide coupled to the frame.

16. A portable workstation comprising:

a tray or basket;

a frame;

a plurality of wheels coupled to the frame;

a plurality of vertical members;

a handle coupled to the vertical members;

a hose support coupled to the vertical members;

a pneumatic inlet port coupled to the frame;

a pump coupled to the frame and pneumatically coupled to the pneumatic inlet port, said pump pumping hydraulic fluid; and outlet ports coupled to the frame and hydraulically coupled to the pump.

17. The portable workstation as recited in claim 16 further comprising a hose guide coupled to at least one of the vertical members.

18. The portable workstation as recited in claim 16 wherein the frame or basket comprises a first basket coupled to the frame.

19. The portable workstation as recited in claim 18 wherein the frame or basket comprises a second basket coupled to the frame.

20. The portable workstation as recited in claim 16 wherein the frame or basket comprises a tray, a first basket and a second basket.

* * * * *